US005209479A

United States Patent [19]

Nagao et al.

[11] Patent Number: 5,209,479

[45] Date of Patent: May 11, 1993

[54] CLOT MACHINE

[75] Inventors: Yuji Nagao, Tokyo; Yoshihiro Kinoshita, Chofu, both of Japan

[73] Assignee: Sigma, Incorporated, Tokyo, Japan

[21] Appl. No.: 863,479

[22] Filed: Apr. 2, 1992

Related U.S. Application Data

[63] Continuation of Ser. No. 593,281, Oct. 5, 1990, abandoned, which is a continuation of Ser. No. 370,022, Jun. 22, 1989, abandoned.

[30] Foreign Application Priority Data

Aug. 12, 1988 [JP] Japan ..... 63-201702

[51] Int. Cl.[5] ..... A63F 7/00; G07F 17/34

[52] U.S. Cl. ..... 273/143 R; 273/138 A

[58] Field of Search ..... 273/138 A, 138 R, 143 R; 364/412

[56] References Cited

U.S. PATENT DOCUMENTS 4,037,845 7/1977 Hooker ..... 273/143 R
4,711,451 12/1987 Pajak et al. ..... 273/143 R
4,715,604 12/1987 Okada ..... 273/143 R
4,772,023 9/1988 Okada ..... 273/143 R
4,790,537 12/1988 Smyth et al. ..... 273/143 R
4,817,951 4/1989 Crouch et al. ..... 273/143 R

FOREIGN PATENT DOCUMENTS 2621154 3/1989 France .
2112984 7/1983 United Kingdom ..... 273/138 A
2131587 6/1984 United Kingdom .
2193025 1/1988 United Kingdom ..... 273/143 R
2210489 6/1989 United Kingdom .

*Primary Examiner*—Jessica J. Harrison, Jr.
*Attorney, Agent, or Firm*—Stevens, Davis, Miller & Mosher

[57] ABSTRACT

The present invention provides a slot machine for determining winning or losing by selecting predetermined symbols from symbol trains arranged on X reels, in accordance with a random number, in which the X reels have symbol trains of different numbers of symbols arranged thereon.

8 Claims, 8 Drawing Sheets

| STOP POSITIONS | 1ST REEL | 2ND REEL | 3RD REEL |
|---|---|---|---|
| 1 | 7B | 7B | 7B |
| 2 | 7B | 7B | BL |
| 3 | 1B | BL | BL |
| 4 | 5B | BL | BL |
| 5 | 1B | 1B | BL |
| 6 | 5B | BL | BL |
| 7 | 1B | 5B | 1B |
| 8 | 1B | BL | BL |
| 9 | 7B | BL | BL |
| 10 | 7B | 1B | BL |
| 11 | 1B | BL | BL |
| 12 | 5B | BL | BL |
| 13 | 1B | 5B | 5B |
| 14 | 5B | BL | BL |
| 15 | 1B | BL | BL |
| 16 | 1B | 1B | BL |
| 17 | | | BL |
| 18 | | | BL |
| 19 | | | 1B |
| 20 | | | BL |
| 21 | | | BL |
| 22 | | | BL |
| 23 | | | BL |
| 24 | | | BL |
| 25 | | | 5B |
| 26 | | | BL |
| 27 | | | BL |
| 28 | | | BL |
| 29 | | | 1B |
| 30 | | | BL |
| 31 | | | BL |
| 32 | | | BL |

| STOP POSITION | 1ST REEL | 2ND REEL | 3RD REEL |
|---|---|---|---|
| 1 | 7B | 7B | 7B |
| 2 | 7B | 7B | BL |
| 3 | BL | BL | BL |
| 4 | BL | BL | 1B |
| 5 | 1B | 1B | BL |
| 6 | BL | BL | BL |
| 7 | 5B | 5B | 5B |
| 8 | BL | BL | BL |
| 9 | BL | BL | BL |
| 10 | 1B | 1B | 1B |
| 11 | BL | BL | BL |
| 12 | BL | BL | BL |
| 13 | 5B | 5B | 5B |
| 14 | BL | BL | BL |
| 15 | 1B | BL | BL |
| 16 | 1B | 1B | 1B |

FIG. 1

*PRIOR ART*

| STOP POSITIONS | 1ST REEL | 2ND REEL | 3RD REEL |
|---|---|---|---|
| 1 | 7B | 7B | 7B |
| 2 | 7B | 7B | BL |
| 3 | 1B | BL | BL |
| 4 | 5B | BL | BL |
| 5 | 1B | 1B | BL |
| 6 | 5B | BL | BL |
| 7 | 1B | 5B | 1B |
| 8 | 1B | BL | BL |
| 9 | 7B | BL | BL |
| 10 | 7B | 1B | BL |
| 11 | 1B | BL | BL |
| 12 | 5B | BL | BL |
| 13 | 1B | 5B | 5B |
| 14 | 5B | BL | BL |
| 15 | 1B | BL | BL |
| 16 | 1B | 1B | BL |
| 17 | | | BL |
| 18 | | | BL |
| 19 | | | 1B |
| 20 | | | BL |
| 21 | | | BL |
| 22 | | | BL |
| 23 | | | BL |
| 24 | | | BL |
| 25 | | | 5B |
| 26 | | | BL |
| 27 | | | BL |
| 28 | | | BL |
| 29 | | | 1B |
| 30 | | | BL |
| 31 | | | BL |
| 32 | | | BL |

FIG. 2

| STOP POSITIONS | 1ST SYM TRAIN | 2ND SYM TRAIN | 3RD SYM TRAIN |
|---|---|---|---|
| 1 | 7B | 7B | 7B |
| 2 | 7B | 7B | BL |
| 3 | 1B | BL | BL |
| 4 | 5B | BL | BL |
| 5 | 1B | 1B | BL |
| 6 | 5B | BL | BL |
| 7 | 1B | 5B | 1B |
| 8 | 1B | BL | BL |
| 9 | | BL | BL |
| 10 | | 1B | BL |
| 11 | | BL | BL |
| 12 | | BL | BL |
| 13 | | 5B | 5B |
| 14 | | BL | BL |
| 15 | | BL | BL |
| 16 | | 1B | BL |
| 17 | | | BL |
| 18 | | | BL |
| 19 | | | 1B |
| 20 | | | BL |
| 21 | | | BL |
| 22 | | | BL |
| 23 | | | BL |
| 24 | | | BL |
| 25 | | | 5B |
| 26 | | | BL |
| 27 | | | BL |
| 28 | | | BL |
| 29 | | | 1B |
| 30 | | | BL |
| 31 | | | BL |
| 32 | | | BL |

FIG. 6

| COMBINATION OF SYMBOL | PRIOR ART | 1ST EMBODIMENT | 2ND EMBODIMENT |
|---|---|---|---|
| 7B•7B•7B | 4/4096 | 8/8192 | 4/4096 |
| 5B•5B•5B | 8/4096 | 16/8192 | 8/4096 |
| 1B•1B•1B | 36/4096 | 72/8192 | 36/4096 |

FIG. 8 A

| COMBINATION OF SYMBOL | PRIOR ART | 1ST EMBODIMENT | 2ND EMBODIMENT |
|---|---|---|---|
| 7B • 7B • – | 60/4096 | 248/8192 | 124/4096 |
| 7B • – • 7B | 28/4096 | 56/8192 | 28/4096 |
| – • 7B • 7B | 28/4096 | 24/8192 | 12/4096 |
| 5B • 5B • – | 56/4096 | 240/8192 | 120/4096 |
| 5B • – • 5B | 56/4096 | 112/8192 | 56/4096 |
| – • 5B • 5B | 56/4096 | 48/8192 | 24/4096 |
| 1B • 1B • – | 156/4096 | 696/8192 | 348/4096 |
| 1B • – • 1B | 156/4096 | 312/8192 | 156/4096 |
| – • 1B • 1B | 156/4096 | 72/8192 | 36/4096 |

FIG. 8B

CLOT MACHINE

This application is a continuation of application Ser. No. 07/593,281, filed Oct. 5, 1990 now abandoned, which in turn is a continuation of application Ser. No. 07/370,022, filed Jun. 22, 1989, now abandoned.

BACKGROUND OF THE INVENTION

1. Field of the Invention

The present invention relates to a slot machine for forming a winning line by selecting predetermined symbols from symbol trains arranged on X reels or from X symbol trains stored in a memory, based on a random number table.

2. Related Background Art

In playing a slot machine, a player places a coin or medal into a coin port provided on a slot machine body and manipulates a start lever or the like to simultaneously rotate several reels having a plurality of symbols drawn on outer peripheries thereof. Those several reels have an equal number of symbols arranged on the outer peripheries thereof.

FIG. 1 shows symbol trains arranged on the outer peripheries of the reels in a prior art slot machine. In the prior art slot machine, the symbol trains having an equal number of symbols are drawn on the outer peripheries of all reels. Accordingly, each symbol arranged on the outer peripheries of the reels indicates the stop position. Each symbol train consists of sixteen symbols which correspond to stop positions (16 positions) of the reel. Accordingly, each symbol arranged on the outer peripheries of the reels indicates the stop position. Each symbol train includes four different symbols (7B, 5B, 1B, BL), and winning combinations are (1) 7B—7B—7B, (2) 5B—5B—5B, and (3) 1B—1B—1B. The symbols which constitute the winning combinations are 7B, 5B and 1B. The symbol train on the first reel includes the symbol 7B at a proportion of 2/16, the symbol 5B at a proportion of 2/16 and the symbol 1B at a proportion of 4/16. The symbol train on the second reel includes the symbol 7B at a proportion of 2/16, the symbol 5B at a proportion of 2/16, and the symbol 1B at a proportion of 3/16. The symbol train on the third reel includes the symbol 7B at a proportion of 1/16, the symbol 5B at the proportion of 2/16 and the symbol 1B at the proportion of 3/16. Accordingly when the first, second and third reels are simultaneously rotated, a probability of occurrence of 7B—7B—7B is 4/4096, a probability of occurrence of 5B—5B—5B is 8/4096, and a probability of occurrence of 1B—1B—1B is 36/4096.

The winning or losing is determined by a combination of symbols appeared on a winning line when the reels are stopped. A probability of winning in such a slot machine depends on the types and number of symbols arranged on the outer peripheries of the reels and number of reels. In a recent slot machine, in order to maintain a pay-out rate at a predetermined level and prevent extreme deviation of a probability of winning depending on technique, one random number is selected from a random number table in a given range, and the winning or losing is determined based on the selected random number.

In a three-reel type slot machine, the selected random number is compared with a probability table to determine the type of winning, and the symbols are determined by referencing symbol tables provided for each reel so that the winning condition is met.

In another slot machine, the selected random number is related to the symbols of the reels, and the symbols of the reels are uniquely determined when the random number is selected.

In the prior art slot machine which determines the symbols of the reels by utilizing the random number, the number of random numbers of a random number table and the number of combinations of symbols of the reels are not equal. For example, where 20 symbols are arranged on each of three reels and 8192 random numbers are derived from 13-bit binary numbers, a total number of combinations of symbols generated for the respective reel stop positions is 8000, which is different from the total random numbers for specific symbol combinations. As a result, even if a specific random number is selected with a uniform probability, 2 different random numbers are often assigned to some symbol combinations and the probability becomes substantially nonuniform when the symbols are determined.

In order to solve the above problem, JP-A-62-213782 disclosed a slot machine in which each of X symbol tables to be referenced when symbols are selected from symbol trains to determine the winning has Y Symbols equal to X-order root of $2^n$.

In this slot machine, a specific random number is selected from the $2^n$ random numbers at the probability of $\frac{1}{2}^n$ and the symbols on the X symbol trains are determined based on the sampled random number. In this case, a probability in determining the symbols by referencing the symbol table is equal to the probability in sampling the random number ($\frac{1}{2}^n$). Accordingly, the combination of symbols finally provided on the winning line is not biased and non-artificial natural game playing can be attained.

In the above slot machine, it is rare for the X-order root of $2^n$ to be an integer and the leeway for the selection of the number Y of symbols arranged on the outer peripheries of the reels is narrow. For example, where 8192 random numbers derived from 13-bit binary numbers and two reels are used, the number of symbols in the symbol table is 90.5096 . . . ($=(2^{13})^{\frac{1}{2}}$). Where three reels are used, the number of symbols in the symbol table is 20.1587 . . . ($=(2^{13})^{\frac{1}{3}}$). Where four reels are used, the number of symbols in the symbol table is 9.5136 . . . ($=(2^{13})^{\frac{1}{4}}$). Thus, perfect integers cannot be generated. For example, when three reels are used and 20 symbols in the symbol table is used, a total number of combinations of symbols is 8000 ($=20^3$), and when 21 symbols are used, it is 9261 ($=21^3$). Thus, when 20 symbols are used, at least 192 ($=8192-8000$) random numbers are weighted by probability.

The above disadvantage of the slot machine is common to a mechanically driven slot machine in which reels are mechanically rotated to move the symbol trains and a video type slot machine in which symbol trains are displayed on a CRT screen.

SUMMARY OF THE INVENTION

It is an object of the present invention to provide a slot machine which allows non-artificial natural game playing without the biasing of the symbol combination attained on a winning line.

In order to achieve the above object, the present invention provides a slot machine for determining winning or losing by selecting predetermined symbols from symbol trains arranged on X reels, in accordance with a random number, in which the X reels have symbol trains having different numbers of symbols arranged thereon.

The X reels may include a first reel and a second reel having a different number of symbols than that of other reels. In the first reel, the number of symbols which constitute a winning combination is larger than in the other reels. In the second reel, the number of symbols which constitute the winning combination is smaller than in the other reels. A probability of concurrent selection of the symbols constituting the winning combination from the symbol train of the first reel and the symbol train of the second reel is equal to a probability of concurrent selection of the symbols constituting the winning combination from the symbol trains of the other reels.

The slot machine may be one which has no reel of a mechanically driven slot machine (that is, a video type slot machine in which symbol trains are stored in a memory such as a ROM).

In accordance with the present invention, the number of random numbers in a random number table can be easily matched, with high precision, to the total number of combination of symbols in symbol trains, with a simple construction.

The present invention will become more fully understood from the detailed description given hereinbelow and the accompanying drawings which are given by way of illustration only, and thus are not to be considered as limiting the present invention.

Further scope of applicability of the present invention will become apparent from the detailed description give herinafter. however, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a view showing symbol trains arranged on outer peripheries of reels of a prior art slot machine, FIG. 2 is a view showing symbol trains in one embodiment of a slot machine of the present invention, FIG. 6 is a view of symbol trains of the second embodiment of the slot machine of the present invention, FIG. 8*a* and 8*b* are views showing probabilities of occurrence of symbol combinations.

DESCRIPTION OF THE PREFERRED EMBODIMENT

A first embodiment of the slot machine of the present invention is explained with reference to FIGS. 2 to 5. A construction of the slot machine of the present embodiment is first explained with reference to FIGS. 3 and 5.

Figure 3:
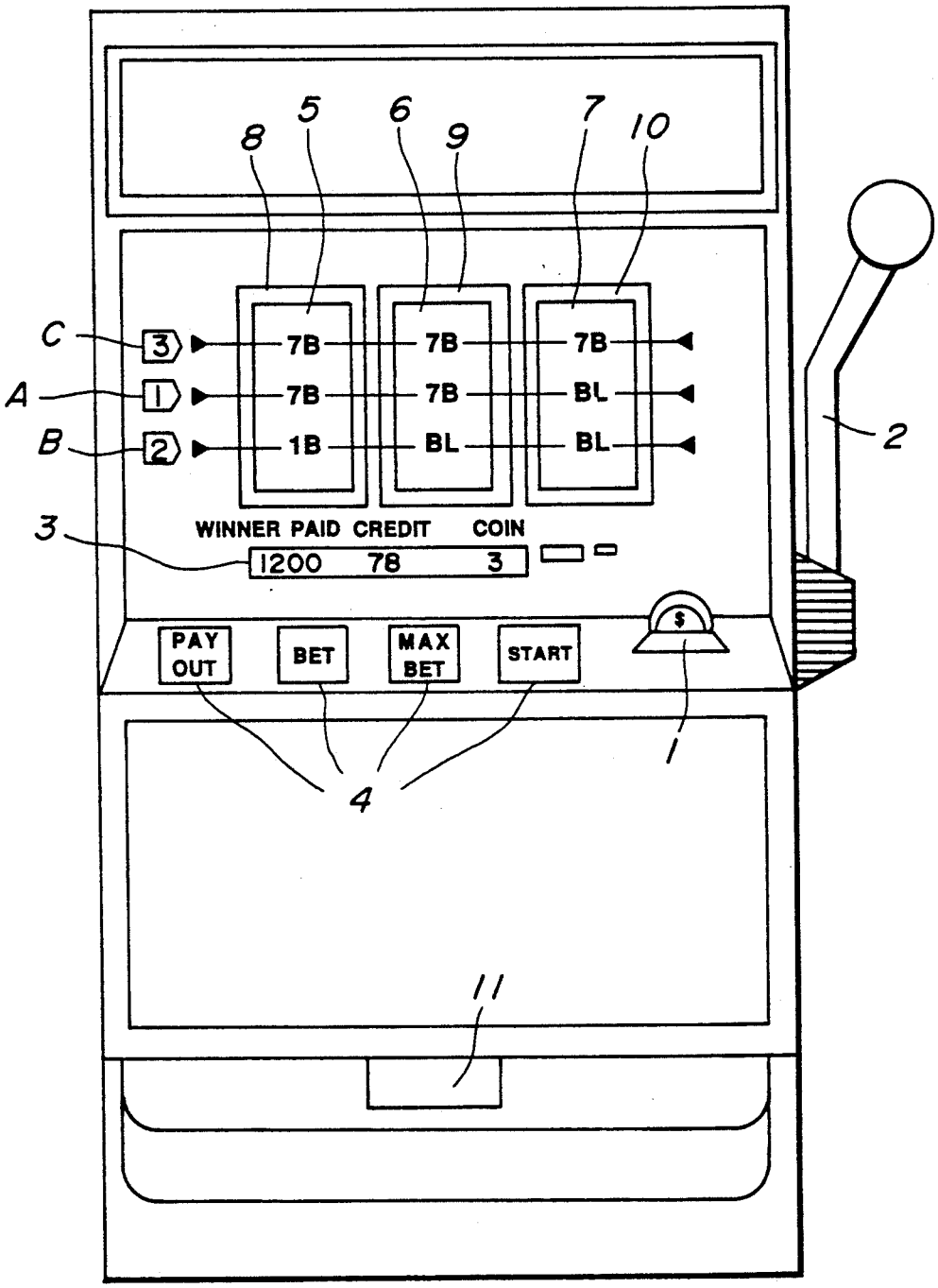
FIG. 3 is a front view of the slot machine of the first embodiment.

FIG. 3 shows an external view of a three-reel type slot machine in one embodiment of the present invention. In playing a game, a player peaces one to three coins into a coin port 1. Which of winning lines A, B and C are valid in a given game are determined in accordance with the number of coins put in. When three coins are put in, the probability of winning is higher. The number of coins put in is digitally displayed by a coin count display 3. The coin count may be indicated by turning on an LED lamp which is related to number 1, 2 or 3. Then, the player depresses a start switch on a game switch unit 4 or pulls a start lever 2 so that the stepping motors for rotating first reel 5, second reel 6 and third reel 7 having symbols arranged on outer peripheries thereof are simultaneously driven. As the first reel 5, second reel 6 and third reel 7 are rotated, the player may observe the movement of symbol trains through windows 8, 9 and 10 provided for the respective reels, through the player cannot identify the individual symbols.

The reels are driven through a microcomputer 32 and a motor driver 21. A stop position of each reel is determined under random number control by a random number generator 13. The stop position of the first reel 5 is determined when the coin is thrown in, and the stop positions of the second reel 6 and the third reel 7 are determined when the player depresses the start switch on the game switch unit 4 or pulls the start lever 2. The random number generator 13 may comprise a 13-bit register which generates 8192 ($=2^{13}$) random numbers. The total number of symbol combinations (for example 8192) is represented by T. T is listed with the odds therefore in a winning table. Therefore, $T=2^n$. Thus, $n=\ln T/\ln 2$ or $\log T/\log 2$, which are derived as follows:

| | |
|---|---|
| $T = 2^n$ | $T = 2^n$ |
| $\ln 2^n = \ln T$ | $\log 2^n = \log T$ |
| $n\ln 2 = \ln T$ | $n \log 2 = \log T$ |
| $n = \ln T/\ln 2$ | $n = \log T/\log 2.$ |

When the first reel 5, second reel 6 and third reel 7 stop, the symbols on the first reel 5, second reel 6 and third reel 7 which are in lines A, B and C are specified. The number of lines which are validated in the winning lines A, B and C is determined by the number of coins thrown into the coin port 1. Where three coins have been thrown in, the winning or losing is determined for each of the winning lines A, B and C. Where one coin has been thrown in, the winning or losing is determined only for the winning line A. If there is a winning combination in any winning line, coins which are equal in number to the degree of winning are paid out from a coin exit 11.

The number of coins thrown in and the number of coins paid out are displayed on the display 3 and the game is over. If there is no winning combination in any winning line, the game is a loss and the game is over.

If the player starts the game after he / she has depressed a bet switch on the game switch unit 4, no coins are paid out but the same number as the number of coins to be paid out is displayed on the display 3 as credit. The credited number is handled as if it were coins. That is, when the bet switch is depressed once, it is recognized as the throw-in of one coin, and the credit number on the display 3 is decreased by one. If a max bet switch is depressed when the credit number is larger than a maximum coin count permitted for the game, it is recognized as the throw-in of the maximum permitted number of coins for the game and the credit number on the display 3 is decreased by the maximum permitted number.

When the player depresses a pay-out switch on the game switch unit 4, the coins equal in number to the credit number are paid out from the coin exit 11.

Figure 4:
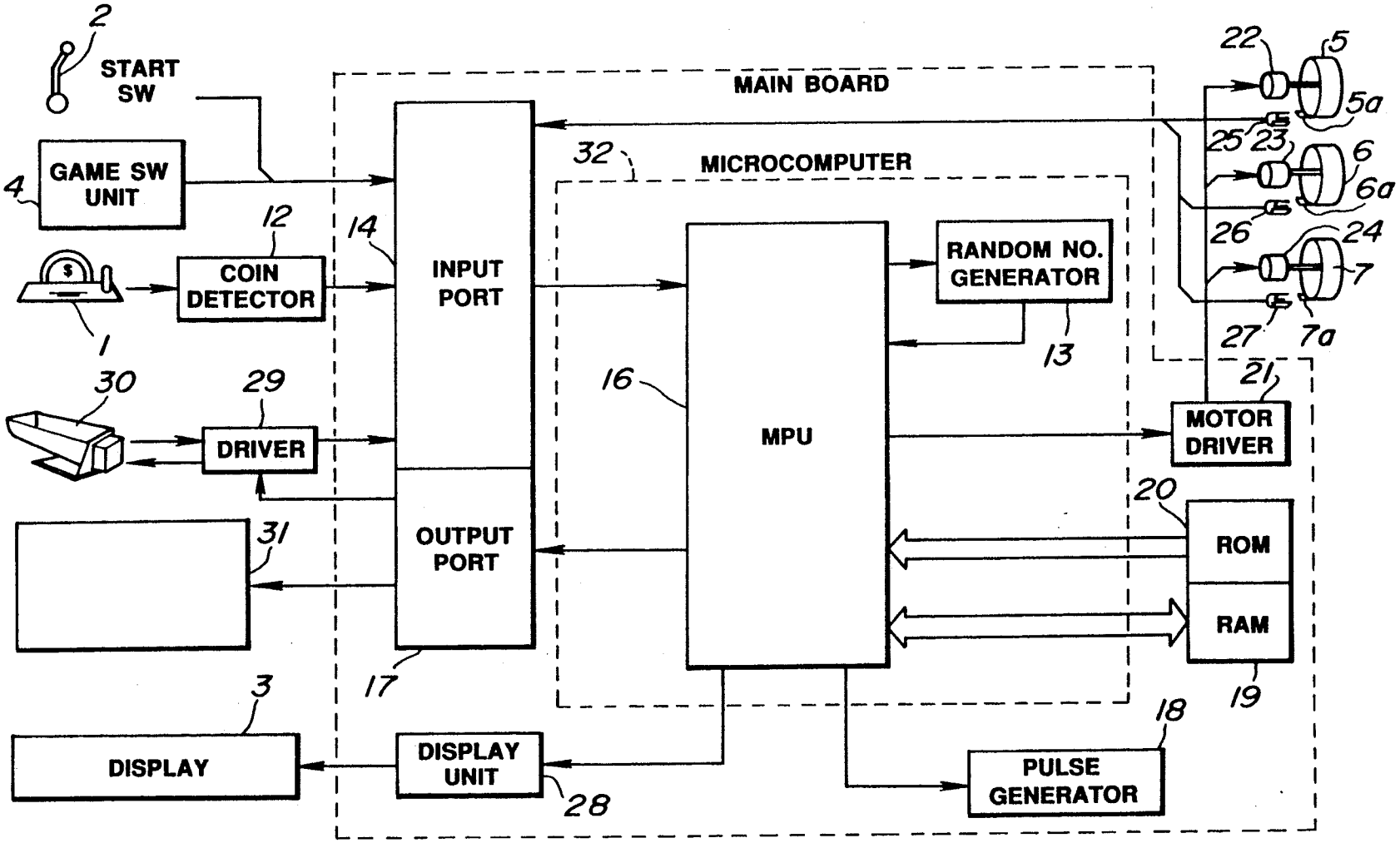
FIG. 4 is a functional block diagram of a circuit configuration of the first embodiment.

FIG. 4 shows a functional block diagram of a circuit configuration of the three-reel type slot machine. Before the game is started, the coins thrown in from the coin port 1, are detected by a coin detector 12 one by one, and the count of detection pulses generated when the coins are detected is supplied to an MPU 16 as a coin count through an input port 14. The coin count supplied to the MPU 16 is stored in a RAM 19 by the MPU 16.

The MPU 16 converts the coin count to data for a display unit 28 and sends it to the display unit 28 so that the display 3 displays the coin count supplied to the MPU 16. The coin count stored in the RAM 19 provides information relating to the winning lines validated in the game for the MPU 16.

Figure 5:
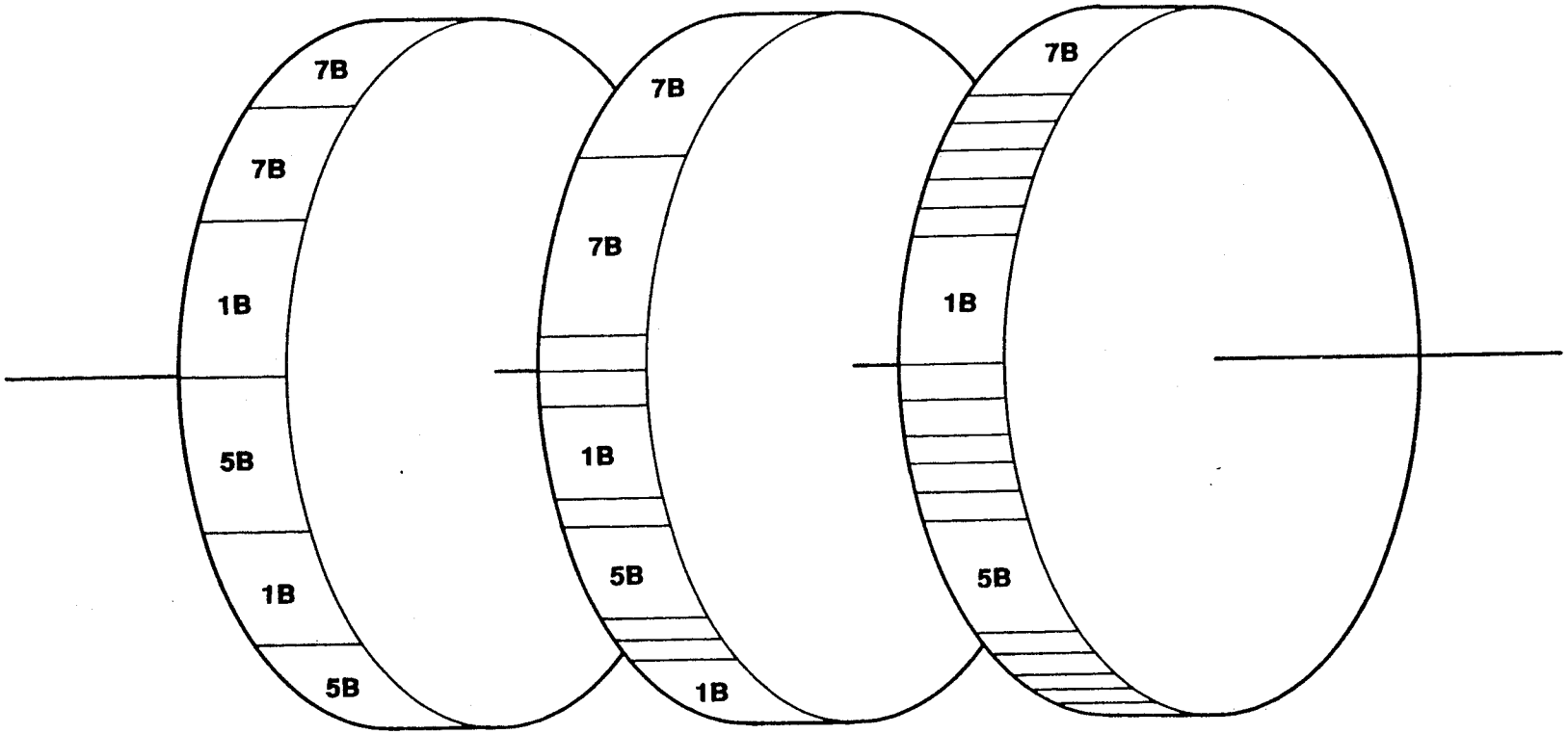
FIG. 5 is a perspective view showing the reel which can be used for the slot machine of the first embodiment.

When the player throws in the coins and manipulates the start switch on the game switch unit 4 or the start lever 2, the MPU 16 reads that information through the input port 14 and it activates the motor driver 21 to rotate the stepping motors 22, 23 and 24. The MPU 16 now supplies a drive pulse to the motor driver 16 by reference to a pulse generated by a pulse generator 18. The first reel 5, second reel 6 and third reel 7 are coupled to drive shafts of the stepping motors 22, 23 and 24, respectively, so that the first reel 5, second reel 6 and third reel 7 are rotated with the stepping motors 22, 23 and 24. Many disproportion-type symbols of having different lengths in peripheral direction is different are arranged on the outer peripheries of each reel. Each symbol corresponds to a stop position. The symbol L whose peripheral length is long has a character such as "7B" or "5B", etc. drawn and the symbol S whose peripheral length is short is blank (hereinafter referred as "BL"). Accordingly, all the characters are not arranged on the outer peripheries of each reel continuously (FIG. 5).

The numbers of pulses supplied to the stepping motor 22, 23 and 24 are stored in the RAM 19 from the MPU 16. Since the rotation angles of the stepping motors 22, 23 and 24 change with the numbers of pulses, the MPU 16 can uniquely determine the rotation positions of the stepping motors 22, 23 and 24.

Projections 5*a*, 6*a* and 7*a* for producing reset signals are provided on portions of the circumferences of the first reel 5, second reel 6 and third reel 7 attached to the drive shafts of the stepping motors 22, 23 and 24. The projections 5*a*, 6*a* and 7*a* are detected by photo-sensors 25, 26 and 27, respectively, in each revolution of the reels, and the detection signals are used to determine reference positions of the reels.

In this manner, the MPU 16 can determine the numbers of pulses to be supplied to the stepping motors in order to reach the stop positions of the reels. The symbol position on the winning line when the first reel 5, second reel 6 and third reel 7 stop corresponds to the numbers of pulses supplied to the stepping motors from the MPU 16.

In the determination of winning, the winning lines validated by the number of coins thrown in are taken into consideration. In the case of winning, the coins are paid out from the exit 11, or if the bet switch of the game switch 4 has been depressed, the number of coins to be paid out is displayed on the display 3 as credit. The MPU 16 supplies a hopper drive signal to a driver 29 through an output port 17 so that the hopper is driven and the coins are paid out. Each time a coin is paid out, a microswitch in the hopper is actuated to generate a pulse.

The pulse is sent to the MPU 16 through a driver 29 and an input port 14. Since the number of pulses sent to the MPU 16 corresponds to the number of coins paid out, the MPU 16 can determine the exact number of coins paid out.

When the number of pulses supplied reaches the number of coins to be paid out, the MPU 16 sends a hopper stop signal to the driver 29 through the output port 17 so that the hopper is stopped.

When the coins have been paid out, the number of coins paid out is displayed on the display 3. The number of coins thrown in for the game is not erased until more coins are put in for the next game.

The symbol trains arranged on the outer peripheries of the first reel 5, second reel 6 and third reel 7 of the slot machine are explained with reference to FIG. 2. In the present embodiment, sixteen symbols are arranged on the outer peripheries of the first reel 5 and second reel 6, and thirty-two symbols are arranged on the outer periphery of the third reel 7. In this case, one stop position is prepared for each symbol and the number of symbols is equal to the number of stop positions.

Each symbol train includes four different symbols (7B, 5B, 1B, BL). The winning combinations are (1) 7B— 7B—7B, (2) 5B—5B—5B, and (3) 1B—1B—1B. The symbol train on the first reel 5 includes the symbols 7B at a proportion of 4/16, the symbols 5B at a proportion of 4/16 and the symbols 1B at a proportion of 8/16. The symbol train on the second reel 6 includes the symbols 7B at a proportion of 2/16, the symbols 5B at a proportion of 2/16 and the symbols 1B at a proportion of 3/16. The symbol train on the third reel includes the symbols 7B at a proportion of 1/32, the symbols 5B at a proportion of 2/32 and the symbols 1B at a proportion of 3/32. Accordingly, when the first reel 5, second reel 6 and third reel 7 are rotated simultaneously, a probability of occurrence of 7B—7B—7B is 8/8192 (=4/4096), a probability of occurrence of 5B—5B—5B is 16/8192 (=8/4096), and a probability of occurrence of 1B—1-B—1B is 72/8192 (=36/4096), which are equal to the probabilities in the symbol trains on the reels of the prior art slot machine (see FIG. 8). It is important to notice that a reel having a different number of symbols arranged on the outer periphery than the number of symbols arranged on the outer peripheries of other reels are included. Namely, the third reel 7, has a different number of symbols (32) than the other reels (16). A total number of combinations of symbols is 8192 ($=16\times16\times32$) which is equal to the number of random numbers generated by the random number generator 13. The number of symbols on the first reel 5 is L. The number of symbols on the second reel 6 is M. The number of symbols on the third reel 7 is N. Accordingly, the combination of the symbols finally displayed on the winning line is not biased, and non-artificial natural game playing is attained. In case to design a slot machine with predetermined probability of occurrence of a winning combination of symbols, the degree of freedom is wide and it is easy to design.

In this case, the proportion of number of symbols constituting a winning combination of symbols (hereinafter referred as "winning symbols") at each reel is arbitrarily determined. For applications, all proportions of reels of which each number of symbols is different may be same. And X reels include the reel of which total symbol number is I and winning symbol number is A (for example, 2nd reel in FIG. 2 where winning symbol is 5B) and the reel of which total symbol number is J and winning symbol number is B (for example, 1st reel in FIG. 2 where winning symbol is 5B) where total symbol number is K and winning symbol number is C for reference reel (for example 3rd reel in FIG. 2 where winning symbol is 5B) and $(A/I)\times(B/J)$ may be equal to $(C/K)^2$. In this case, the probability of occurrence of winning symbol is same as that of slot machine with all reference reels.

Further, when a slot machine has more than 4 reels, a pair of reels of which total symbol number and winning symbol number are different from K and C, may be used instead of a couple of reference reels. In this case, the reel of which total symbol number is L and winning symbol number is D, and the reel of which total symbol number is M and winning symbol number is E may be used so that $(D/L)\times(E/M)$ can be equal to $(C/K)^2$.

The present invention may also be applied to a slot machine which refers the symbol tables for the reels and determines symbols of X symbol trains in accordance with random numbers. In this case, the numbers on its symbols of symbol trains in the symbol tables may be different from each other. It is important to notice that the number on symbols of symbol train referenced based on random numbers on selection of symbol is not same.

A second embodiment of the slot machine is now explained with reference to FIGS. 6 and 7. A construction of the slot machine of the present embodiment is first explained with reference to FIG. 7. Since an external view of the slot machine is essentially the same as that of the first embodiment, the explanation thereof in omitted.

Figure 7:
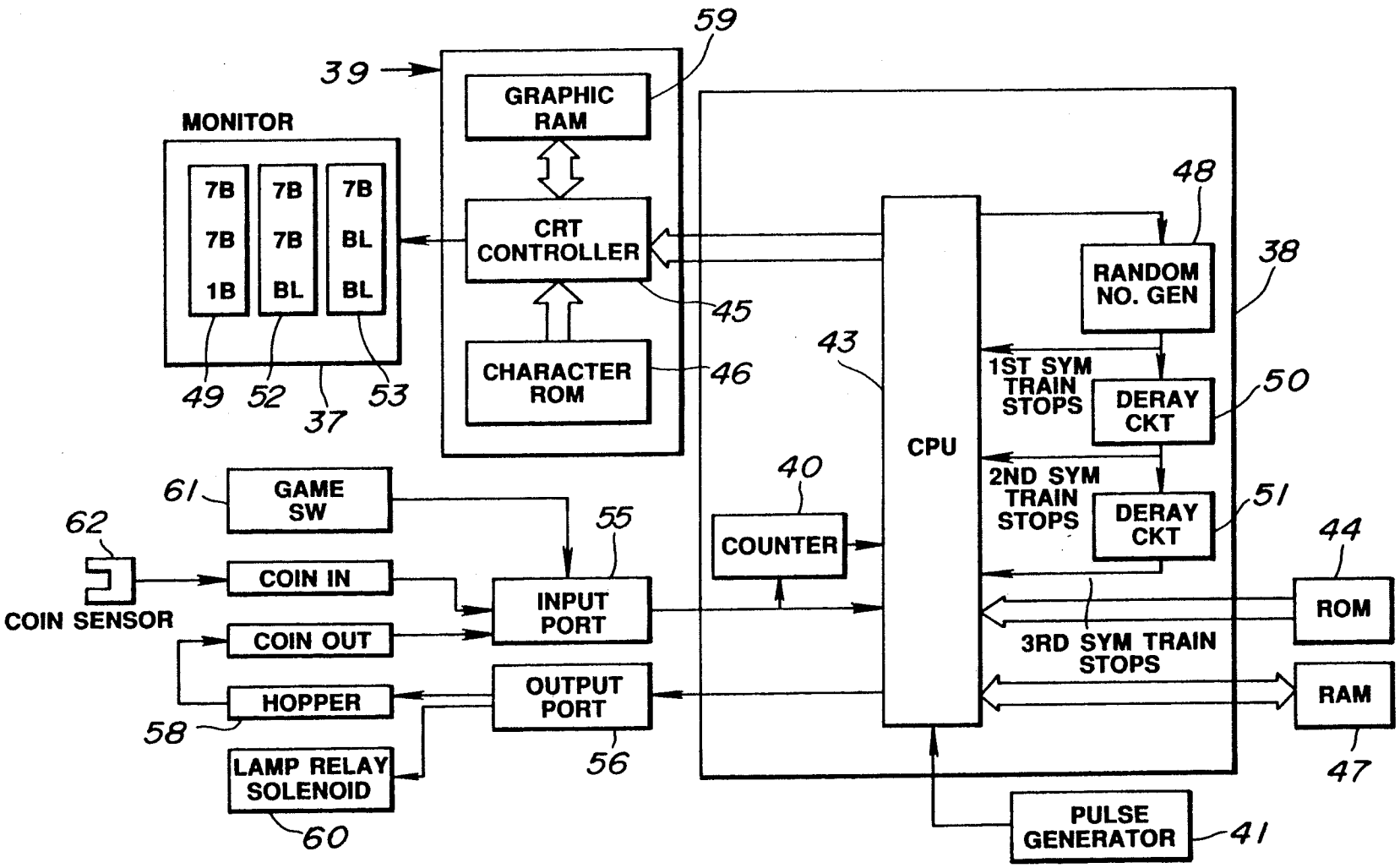
FIG. 7 is a functional block diagram of a circuit configuration of the second embodiment.

FIG. 7 shows a video-type slot machine in accordance with the present invention. It shows a functional block diagram of a circuit configuration of a three-reel type slot machine. A CRT 37 is provided at the position of the reels in the video-type slot machine. The CRT 37 is driven by a micro computer 38 and a CRT driver 39, and nine symbols in total are displayed in matrix on the display screen.

Before the game is started, the number of coins thrown in are counted by a counter 40 with the data supplied from an input port 55. The number of effective lines for winning on the display screen is determined by the number of coins thrown in. The winning effective lines are referenced in determining the winning.

When a start button is depressed, a clock pulse is supplied from a pulse generator 41 to the CPU 43 and a microcomputer 38 is activated. The microcomputer 38 processes the game in accordance with a game program stored in a ROM 44. As the microcomputer 38 is activated, a CRT controller 45 is activated and character data of the symbols to be displayed on the CRT 37 from a character ROM 37 are accessed in an address sequence so that the symbols are displayed with scrolling. The ROM 44 stores, in addition to the game program, the contents of three symbol tables corresponding to the mechanical reels and a winning table.

The displayed symbol address data is held while it is sequentially updated in a RAM 47. After a predetermined time period, the scrolling of the first symbol train 49 vertically displayed on the CRT 37 is stopped by a stop signal generated by a random number generator 48 so that three symbols are specified. By stop signals sequentially produced from delay circuits 50 and 51, the scrolling of the second symbol train 52 and the third symbol train 53 is stopped. In this manner, nine symbols in total are specified. The random number generator 48 comprises a 12-bit register which generates 4096 ($=2^{12}$) random numbers. The stop positions in the symbol trains are specified in accordance with the random numbers.

The RAM 47 stores the address data of the symbols displayed on the CRT 37 and the display position data. When the scrolling of all symbol trains 49, 52 and 53 stops, whether the combination of symbols displayed along the validated winning line is the winning combination or not is determined. The address data stored in the winning table memory of the ROM 44 and the data stored in the RAM 47 are compared to get the determination of the winning.

In order to display the symbols which constitute the winning combination distinctively from other symbols, the background of the symbols may be changed or color of the symbols may be reversed from that of regular display colors. The CPU 43 has input port 55 and output port 56 connected thereto. The output port 56 supplies a drive signal to a hopper 58 in response to a signal from the CPU 43. The hopper 58 pays out a predetermined number of coins corresponding to the type of winning in response to the signal from the output port 56. When the hopper 58 has paid out the predetermined number of coins, a normal symbol display mode is restored and the slot machine is reset to the initial state.

Referring to FIG. 6, the arrangement of the symbols which form the first symbol train 49, second symbol train 52 and third symbol train 53 of the three symbol tables (not shown) in the ROM 44 is explained. The three symbol table memories in the ROM 44 store 8 symbols for the first symbol train 49, 16 symbols for the second symbol train 52, and 32 symbols for the third symbol train 53. In this case, one stop position is prepared for each symbol and the number of symbols is equal to that of stop positions.

Each symbol train includes four different symbols (7B, 5B, 1B, BL), and the winning combinations are (1) 7B—7B—7B, (2) 5B—5B—5B, and (3) 1B—1B—1B. The first symbol train 49 includes the symbols 7B at a proportion of 2/8, the symbols 5B at a proportion of 2/8, and the symbols 1B at a proportion of 4/8. The second symbol train 52 includes the symbols 7B at a proportion of 2/16, symbols 5B at a proportion of 2/16 and the symbols 1B at a proportion of 3/16. The third symbol train 53 includes the symbols 7B at a proportion of 1/32, symbols 5B at a proportion of 2/32 and the symbols 1B at a proportion of 3/32. Accordingly, when those symbol trains are simultaneously scrolled, a probability of occurrence of 7B—7B—7B is 4/4096, a probability of occurrence of 5B—5B—5B is 8/4096, and a probability of occurrence of 1B—1B—1B is 36/4096, which are equal to the probabilities in the symbol trains on the reels of the prior art slot machine (see FIG. 1).

It is important to notice that when the number of symbols is one of the three symbol trains in increased and the number of symbols in another symbol train is decreased, the final probability for the winning symbol combination (for example, 7B—7B—7B) is not changed. To this end, the number of symbols of the second symbol train 52 is equal to the reference number (no change in the number symbols), the number of symbols of the first symbol train 49 is decreased from 16 to 8, and the number of symbols of the third symbol train 53 is increased from 16 to 32 so that the final probability does not change from that where three standard symbol trains are used. A total number of combinations of symbols is 4096 ($=8\times16\times32$) which is equal to the number of random numbers generated by the 12-bit register of the random time 48. Accordingly, there is no deviation in the symbol combinations displayed on the winning lines, and non-artificial natural game playing is attained. When attempting to design a slot machine with a predetermined probability of occurrence of a winning combination of symbols, the degree of freedom is wide.

FIG. 8 shows probabilities of occurrence of symbol combination. FIG. 8A shows winning combinations, and FIG. 8B shows combinations of one-symbol losing and probabilities thereof. As seen from FIG. 8A, the numbers of symbols are controlled such that the probability of winning is not changed by the change of numbers of symbols. In the slot machine of the present embodiment, however, the probabilities of combinations of one-symbol losing (for example, 7B—7B—5B) are high as seen from FIG. 8B.

The number of reels, the number of symbols and the number of symbol trains whose numbers of symbols are increased or decreased are not limited to those shown in the above embodiments. For example, the symbol trains of the first embodiment (FIG. 2) and the symbol trains described as the application may be applied to the slot machine of the second embodiment, or the symbol trains of the second embodiment (FIG. 6) may be applied to the slot machine of the first embodiment.

The number of symbol trains whose numbers of symbols are increased or decreased is not limited to two. For example, in a seven-reel slot machine, the number of symbols on the first reel in the symbol trains arranged on the outer peripheries of the reels may be larger than the number of symbols of the fifth reel (or sixth or seventh reel) (hereinafter referred to as "reference number of symbols"), the number of symbols of the second reel may be smaller than the reference number, the number of symbols of the third reel may be larger than the reference number, and the number of symbols of the fourth reel may be smaller than the reference number. In this case, a probability $\alpha$12 of occurrence of a winning combination (for example, 7B—7B) when the first reel and the second reel are simultaneously rotated, a probability $\alpha$34 of occurrence of the winning combination (for example, 7B—7B) when the third reel and the fourth reel are simultaneously rotated, and a probability $\alpha$56 of occurrence of the winning combination (for example, 7B—7B) when the fifth reel and the sixth reel (having the equal number of symbols) are equal.

In this case, the numbers of symbols of the first reel and the second reel may be increased and the number of symbols of the third reel may be reduced. A probability $\alpha$123 of the occurrence of a winning combination (for example, 7B—7B—7B) when the first reel, second reel and third reel are simultaneously rotated, and a probability $\alpha$567 of the occurrence of the winning combination (7B—7B—7B) when the fifth reel, sixth reel and seventh reel (having the equal number of symbols) are simultaneously rotated are equal.

The numbers of symbols of the symbol train may be arbitrary and they are not limited to 8, 16 and 32.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

We claim:

1. A slot machine comprising:

a random number generator which generates a random number, having the highest number of random numbers satisfying $2^n$ wherein n is a positive integer, each random number corresponding to one of a plurality of symbol combinations stored in memory means;

reels, each having a plurality of symbols arranged thereon, at least one of said reels having a different number of symbols than the other reels, said symbols corresponding to those in the symbol combinations stored in the memory means; and memory means which stores all the symbol combinations and the likelihood of the selection of each symbol combination, the total number of combinations being $L\times M\times N$, wherein L is the number of symbols on a first reel, M is the number of symbols on a second reel and N is the number of symbols on a third reel;

wherein $2^n$ and the number of symbol combinations are equal to each other.

2. A slot machine according to claim 1, wherein n is log T/log 2 or ln T/ln 2, wherein T is the total number of symbol combinations.

3. A slot machine comprising:

a random number generator which generates a random number, having the highest number of random numbers satisfying $2^n$ wherein n is a positive integer, each random number corresponding to one of a plurality of symbol combinations to be used in a game;

symbol memory means which stores symbols to be used for said symbol combinations;

display means which shows a plurality of symbols in series, said symbols in series corresponding to those in the symbol combinations selected;

combination memory means which stores all the symbol combinations and the likelihood of the selection of each symbol combination, the total number of combinations being $L\times M\times N$, wherein L is the number of symbols in a first series of symbols, M is the number of symbols in a second series of symbols, and N is the number of symbols in a third series of symbols at least one of L, M, and N being different than the other two and display controller means which retrieves from the symbol memory means the symbols in the symbol combination corresponding to the random number generated by the random number generator and controls the display of said symbols in series by the display means;

wherein $2^n$ and the number of symbol combinations are equal to each other.

4. A slot machine according to claim 3, wherein n is log T/log 2 or ln T/ln 2, wherein T is the total number of symbol combinations.

5. A slot machine comprising:

a random number generator which generates a random number, having the highest number of random numbers satisfying $2^n$ wherein n is a positive integer, each random number corresponding to one of a plurality of symbol combinations stored in memory means;

reels, each having a plurality of symbols arranged thereon, at least one of said reels having a different number of symbols than the other reels, said symbols corresponding to those in the symbol combinations;

selection means for selecting a symbol from each of said reels to constitute a symbol combination to be used; and memory means which stores the likelihood of the selection of each symbol combination, each symbol combination being selected by said selection means;

wherein $2^n$ and the number of symbol combinations are equal to each other.

6. A slot machine comprising:

a random number generator which generates a random number, having the highest number of random numbers satisfying $2^n$ wherein n is a positive integer, each random number corresponding to one of a plurality of symbol combinations to be used in a game;

symbol memory means which stores symbols to be used for said symbol combinations;

display means which shows a plurality of symbols in series, said symbols in series corresponding to those in the symbol combinations selected, at least one series of symbols having a different number of symbols than the other series;

selection means for selecting a symbol from each of said series of symbols to constitute a symbol combination to be used;

combination memory means which stores the likelihood of the selection of each symbol combination, each symbol combination being selected by said selection means; and display controller means which retrieves from the symbol memory means the symbols in the symbol combination corresponding to the random number generated by the random number generator and controls the display of said symbols in series by the display means;

wherein $2^n$ and the number of symbol combinations are equal to each other.

7. A slot machine comprising:

a random number generator which generates a random number, having the highest number of random numbers satisfying $2^n$ wherein n is a positive integer, each random number corresponding to one of a plurality of symbol combinations stored in memory means;

reels, each having a plurality of symbols arranged thereon, at least one of said reels having a different number of symbols than the other reels, said symbols corresponding to those in the symbol combinations;

selection means for selecting a symbol from each of said reels to constitute a symbol combination to be used; and memory means which stores the likelihood of the selection of each symbol combination, each symbol combination being selected by said selection means;

wherein $2^n$ and the number of symbol combinations are equal to each other and n is not more than 13.

8. A slot machine comprising:

a random number generator which generates a random number, having the highest number of random numbers satisfying $2^n$ wherein n is a positive integer, each random number corresponding to one of a plurality of symbol combinations to be used in a game;

symbol memory means which stores symbols to be used for said symbol combinations;

display means which shows a plurality of symbols in series, said symbols in series corresponding to those in the symbol combinations selected, at least one series of symbols having a different number of symbols than the other series;

selection means for selecting a symbol from each of said series of symbols to constitute a symbol combination to be used;

combination memory means which stores the likelihood of the selection of each symbol combination, each symbol combination being selected by said selection means; and display controller means which retrieves from the symbol memory means the symbols in the symbol combination corresponding to the random number generated by the random number generator and controls the display of said symbols in series by the display means;

wherein $2^n$ and the number of symbol combinations are equal to each other and n is not more than 13.

* * * * *